US008196570B2

(12) United States Patent
Christensen et al.

(10) Patent No.: US 8,196,570 B2
(45) Date of Patent: Jun. 12, 2012

(54) BOW UTILIZING ARCUATE COMPRESSION MEMBERS TO STORE ENERGY

(75) Inventors: Ronald J. Christensen, Gunnison, UT (US); Jason Christensen, Gunnison, UT (US)

(73) Assignee: TDJ Incorporated, Fayette, UT (US)

( * ) Notice: Subject to any disclaimer, the term of this patent is extended or adjusted under 35 U.S.C. 154(b) by 291 days.

(21) Appl. No.: 12/720,233

(22) Filed: Mar. 9, 2010

(65) Prior Publication Data

US 2011/0220085 A1 Sep. 15, 2011

(51) Int. Cl.
*F41B 5/10* (2006.01)
*F41B 5/00* (2006.01)

(52) U.S. Cl. ..... 124/25.6; 124/23.1

(58) Field of Classification Search ..... 124/23.1, 124/25.6, 86, 88; 267/158, 164
See application file for complete search history.

(56) References Cited

U.S. PATENT DOCUMENTS

| | | | | | |
|---|---|---|---|---|---|
| 126,734 | A | * | 5/1872 | Morton | 124/23.1 |
| 1,029,716 | A | * | 6/1912 | Roe | 124/23.1 |
| 3,965,883 | A | * | 6/1976 | Meyer | 124/23.1 |
| 4,018,205 | A | * | 4/1977 | Meyer | 124/23.1 |
| 4,227,509 | A | * | 10/1980 | Jones | 124/25.6 |
| 4,246,883 | A | * | 1/1981 | Ash | 124/25.6 |

* cited by examiner

*Primary Examiner* — John Ricci
(74) *Attorney, Agent, or Firm* — Thorpe North & Western LLP

(57) ABSTRACT

According to one embodiment, a bow includes a handle portion and a bowstring. Compression members including primary compression elements and secondary compression elements are positioned on the ends of the handle portion. The compression elements are arcuate in shape and joined at the ends. As the bowstring is drawn, the compression members are compressed and energy is stored therein. The bow can include limbs that do not significantly deform or store energy as the bow is drawn. Upon release of the bowstring, the stored energy is rapidly returned to the bowstring.

20 Claims, 9 Drawing Sheets

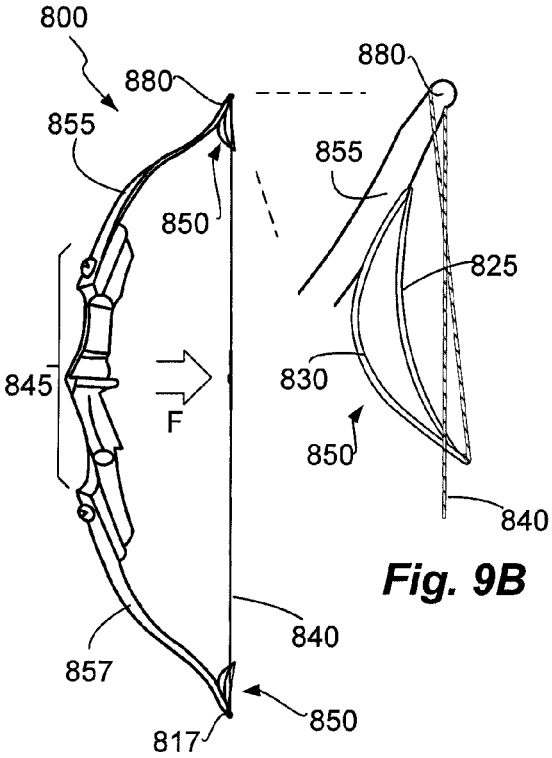
Fig. 9A
Fig. 9B
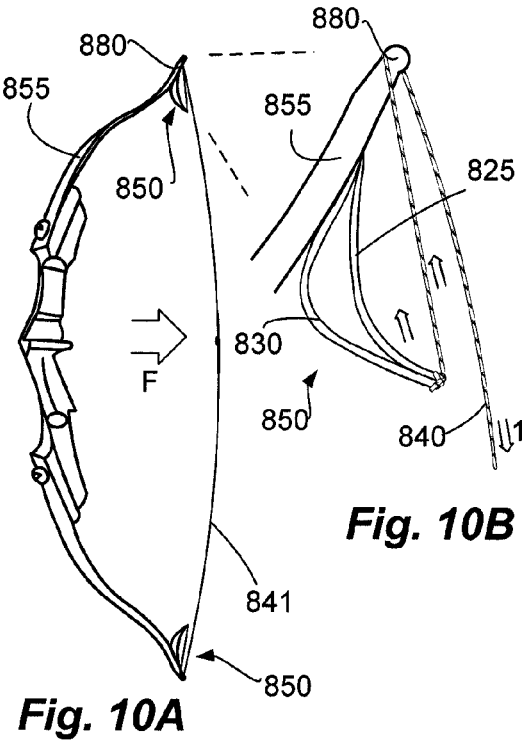
Fig. 10A
Fig. 10B
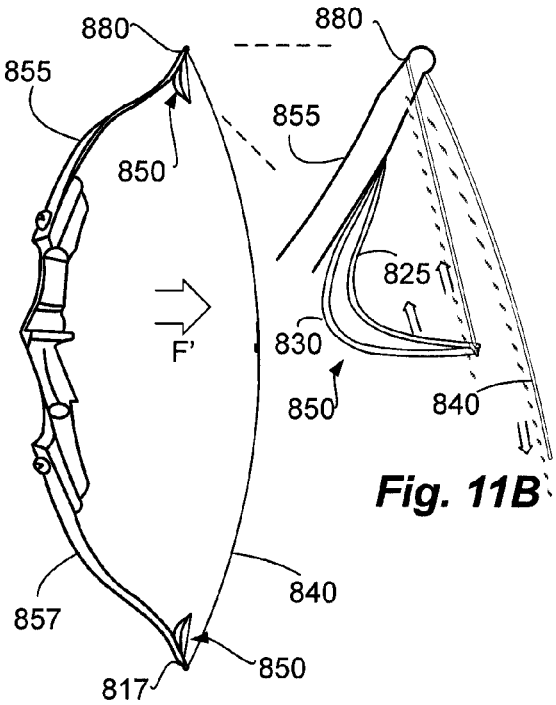
Fig. 11A
Fig. 11B
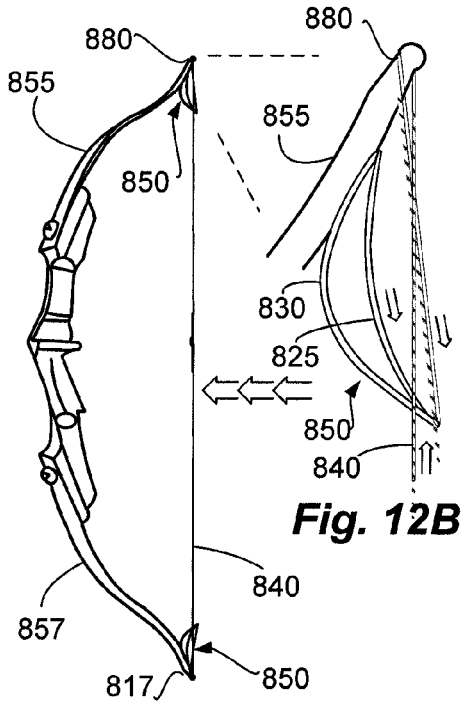
Fig. 12A
Fig. 12B

BOW UTILIZING ARCUATE COMPRESSION MEMBERS TO STORE ENERGY

TECHNICAL FIELD

The present exemplary system and method relate to archery and hunting bows. More particularly, the present exemplary system and method relate to a system and a method for storing energy as a bowstring is drawn back for the propulsion of an arrow.

BACKGROUND

Bows have been used for archery and hunting for hundreds of years and are available in a variety forms, including long bows, recurve bows, crossbows, compound bows, and several other types. All bows are generally configured to propel an arrow. Due to current innovations, the compound bow is the most commonly used type of bow. However, the recurve bow is also widely known and used. In typical recurve bows and long bows, as a bowstring is drawn, the limbs of the bow are bent inward. The bending of the limbs stores a significant amount of energy in the bow structure known as draw weight, often measured in pounds of force required to maintain the limbs of the bow in a given bent position. Upon release of the bowstring, the bent limbs rapidly return to their original shape. As the bent limbs rapidly return to their original shape, a significant amount of kinetic energy is translated to the bowstring, thrusting it forward, which in turn propels an arrow.

Compound bows differ from recurve bows in that wheels, cams, and/or eccentrics are attached to the free ends of the limbs. These eccentrics provide a mechanical advantage in bending the limbs of the bow. Additionally, compound bows provide what is known as "let-off". "Let-off" is a point in a draw at which only a fraction of the originally applied force is required to maintain the limbs of the bow in a position that maximizes energy storage. Let-off is often measured as a percentage of force that is no longer required to maintain the limbs in the maximally bent position. Thus, it might be said that a given compound bow has an 80% let-off, meaning that the force required to maintain the bow at a drawn position is reduced by 80% compared to the draw weight.

Many of the latest innovations regarding bows are directed toward reducing undesirable vibrations, recoil, and noise during use. During operation, an arrow is nocked (secured to the bowstring) and the bowstring is drawn to full draw. This causes the limbs to bend and store energy that is subsequently released to propel an arrow. When the bowstring is released, most of the kinetic energy stored within the limbs is transferred to the bowstring, which propels the arrow. Ideally, all the energy would be transferred to the arrow. However, in reality only between 70-85% of the stored energy in traditional compound bows is transferred to the arrow. The remaining portion of the energy is transferred back into the bow and to the user. This returned energy is called recoil. Recoil is typically manifest as unwanted vibrations that reduce a user's accuracy.

In addition to recoil, the release of the bowstring, eccentrics, and limbs produces sound. The sound produced is often sufficiently loud to alert wild animals of the presence of the archer, causing them to jump or move. That is, the noise causes the animal to "jump the string", resulting in a miss or a non-fatal strike. Consequently, bows configured for quieter operation are desirable over traditional compound bows.

Numerous recent improvements to compound bows are centered on improving the recoil, noise, and let-off. It is desirable to have a sufficient let-off while minimizing the noise and recoil. The use of eccentrics, while providing sufficient let-off, creates additional noise. Additionally, both recurve and compound bows rely on the bending of the limbs to store and rapidly return energy. This results in significant recoil as the limbs lurch forward upon release. Recent improvements are only marginally effective and often result in a reduction in arrow speed. For example, stabilizers and vibration-reduced limbs absorb energy that ideally would be transferred to the arrow.

Furthermore, as previously stated, compound and recurve bows rely on the bending of the limbs and rotation of eccentrics of the bow to store energy. In addition to wasted energy being expended as noise and vibration, as much as 45% of the stored energy is expended in returning the limbs to their original state. The amount of energy expended in restoring the limbs to the undrawn position is largely dependent upon the weight of the limbs and the distance they are displaced at full draw. Consequently, various methods have been contrived to reduce the weight and/or amount of limb deformation. However, in order to increase the draw weight, limbs are typically made wider and/or thicker. The formation of wider and/or thicker limbs, absent a material change, typically increases the weight of the limbs, thereby decreasing the efficiency. Accordingly, there is a long felt need for bows having increased efficiency, reduced noise and recoil, adequate let-off, and sufficient draw weight.

SUMMARY

According to one exemplary embodiment, a bow is configured including a handle section and a bowstring. According to one exemplary embodiment, the bow can include upper and lower limbs. According to one exemplary embodiment, a compression member is used to store and release energy in the exemplary bow configuration. The exemplary compression member includes a primary compression element in the form of an arc or crescent and a secondary compression element coupled to the primary compression element having a shorter arc length and radius of curvature. According to one exemplary embodiment, the exemplary compression members are coupled to the handle section. According to one exemplary embodiment, the exemplary compression members are disposed on the open ends of both the upper and lower limbs of the bow.

According to an alternative embodiment, the compression member includes various alternative configurations of coupled primary and secondary compression elements. According to yet another alternative embodiment, multiple secondary compression elements are joined to a primary compression element disposed on the open end of a limb.

According to one exemplary embodiment, compression members are positioned at the open ends of each limb and extend away from the center of the bowstring. According to another embodiment, compression members are positioned at the open ends of each limb and extend inward, toward the center of the bowstring. According to this embodiment, the bowstring passes around or through the tip of the limb prior to attachment to the compression member.

According to various exemplary embodiments, the compression members are compressed as the bowstring of the present bow configuration is drawn. A significant amount of energy is stored in the compressed compression members. When the bowstring is released the compressed members rapidly return to their natural static state, thereby releasing the stored energy. As the weight of the compression member is minimal and the distance traveled is very short, the compression members will efficiently transfer nearly 100% of the stored energy to the bowstring, which then propels an arrow.

According to one exemplary embodiment, due to the material and geometric configuration of the compression members, the bow provides a let-off comparable to prior art compound bows. The compression members command a significant amount of force to compress, but once compressed to a certain point, require a minimal amount of force to maintain the members in a maximally compressed state. For example, a bow configured with a 75-pound draw weight, may only require 10-35% of this force to maintain it fully drawn.

According to various embodiments, the present system and method provides a bow configuration that is silent or nearly silent when fired. According to various embodiments of the present system and method, as the bowstring is drawn, a majority of the energy is directed to the deformation of the compression members. Very little deformation, if any, occurs in the limbs of the bow due to their rigid configuration and structure. This provides a far superior bow over the prior art with regards to efficiency and recoil. Because the bow is configured with compression members on the upper and lower limb, when the bowstring is released, the recoil is isolated to the vertical direction. Lateral or horizontal recoils are greatly reduced or eliminated. Furthermore, the vertical recoils in each of the compression members on the limbs of the bow are in opposite directions and therefore cancel each other out. In sum, by not requiring the limbs to store energy, the present bow eliminates significant recoil.

Consequently, it can be seen that the present system and method provide a bow that has sufficient let-off and is nearly 100% efficient. Furthermore, the bow is nearly silent and has no significant recoil. Therefore, the presently described bow maintains every advantage of traditional compound bows, while decreasing the weight, increasing efficiency, and minimizing recoil. Specific details of the various embodiments of the present system and method are provided below. In addition, the characteristics of several exemplary compression members are described in detail.

BRIEF DESCRIPTION OF THE DRAWINGS

The accompanying drawings illustrate various embodiments of the present system and method and are a part of the specification. The illustrated embodiments are merely examples of the present system and method and do not limit the scope thereof.

FIGS. 9A-12B illustrate the method of use, the method by which energy is stored and released, and the interaction between the bowstring and the compression members, according to various exemplary embodiments.

Figure 1A:
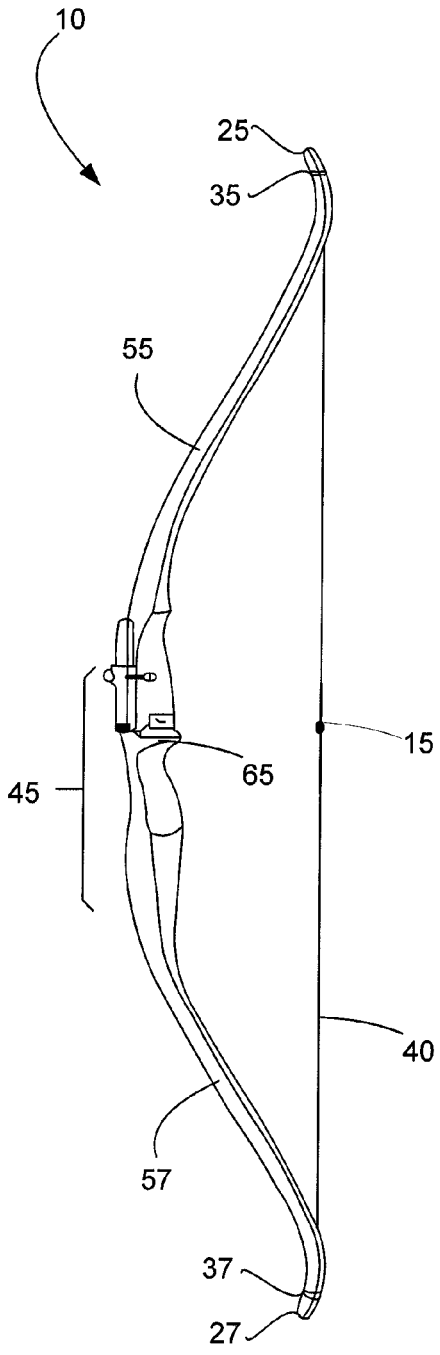
Fig. 1A Prior Art
FIG. 1A illustrates a traditional recurve bow, according to one exemplary embodiment.

Throughout the drawings, identical reference numbers identify similar elements or features. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of and distances between elements as drawn, are not intended to convey any information regarding the actual shape of the particular elements, and have been solely selected for ease of recognition in the drawings.

DETAILED DESCRIPTION

An exemplary system and method of a bow utilizing arcuate compression members is described herein. Specifically, exemplary bows are described that include handle sections, bowstrings, and opposing limbs each having compression members disposed thereon. According to various exemplary embodiments, little or no energy is stored in the limbs of the bow. Rather, the present exemplary system and method stores and releases energy using the exemplary compression members. Additionally, specific details are provided regarding the individual compression members and the elements that make up the compression members. Additionally, various exemplary geometric configurations that result in efficient compression members are disclosed.

Moreover, according to various exemplary embodiments, the present exemplary compression members provide a let-off comparable to traditional compound bows. Consequently, details of exemplary force-deflection and draw weight-draw length curves are provided below. The present specification discloses many exemplary implementations of the present system and method. However, it will be recognized that many variations of the present exemplary system and method are possible in light of this disclosure.

In the following description, for purposes of explanation, numerous specific details are set forth in order to provide a thorough understanding of the present system and method of utilizing arcuate compression members to store energy in a bow. It will be apparent, however, to one skilled in the art, that the present method may be practiced without many of these specific details or with modification of these specific details. Reference in the specification to "one embodiment" or "an embodiment" means that a particular feature, structure, or characteristic described in connection with the embodiment is included in at least one embodiment. The appearance of the phrase "in one embodiment" in various places in the specification are not necessarily all referring to the same embodiment.

FIG. 1A illustrates a traditional recurve bow (10) including a riser (45) with a handle portion, an upper limb (55), and a lower limb (57), where each limb has a string nock (35, 37) and a limb tip (25, 27). Additionally, the bow in FIG. 1A is illustrated with a bowstring (40) and an arrow nock (15). The recurve bow (10) is configured to receive an arrow by nocking the tail end of an arrow on the arrow nock (15) and resting the shaft of the arrow on the arrow rest (65).

Grasping the bowstring (40) near the arrow nock (15) and pulling it away from the riser (45) draws the bow. As the bowstring (40) is pulled the upper (55) and lower (57) limbs are bent inward. The limbs (55, 57) store energy as they resist the deflection. Once the bow (10) is fully drawn, the bowstring (40) can be released, allowing the limbs (55, 57) to rapidly return to their original position. As the limbs (55, 57) return to their original position, energy is returned to the bowstring (40), thrusting it forward and propelling an arrow (not shown).

While quite efficient, the recurve bow (10) suffers from several disadvantages. It requires a great amount of force to maintain the bow fully drawn, making it difficult to aim during use. Furthermore, the limbs (55, 57) of the recurve bow (10) are deflected a great distance at full draw. Consequently, when fired, a significant amount of energy is returned to the user in the form of recoil as the bow lurches forward. Recoil represents wasted energy and often further disrupts a user's aim.

Figure 1B:
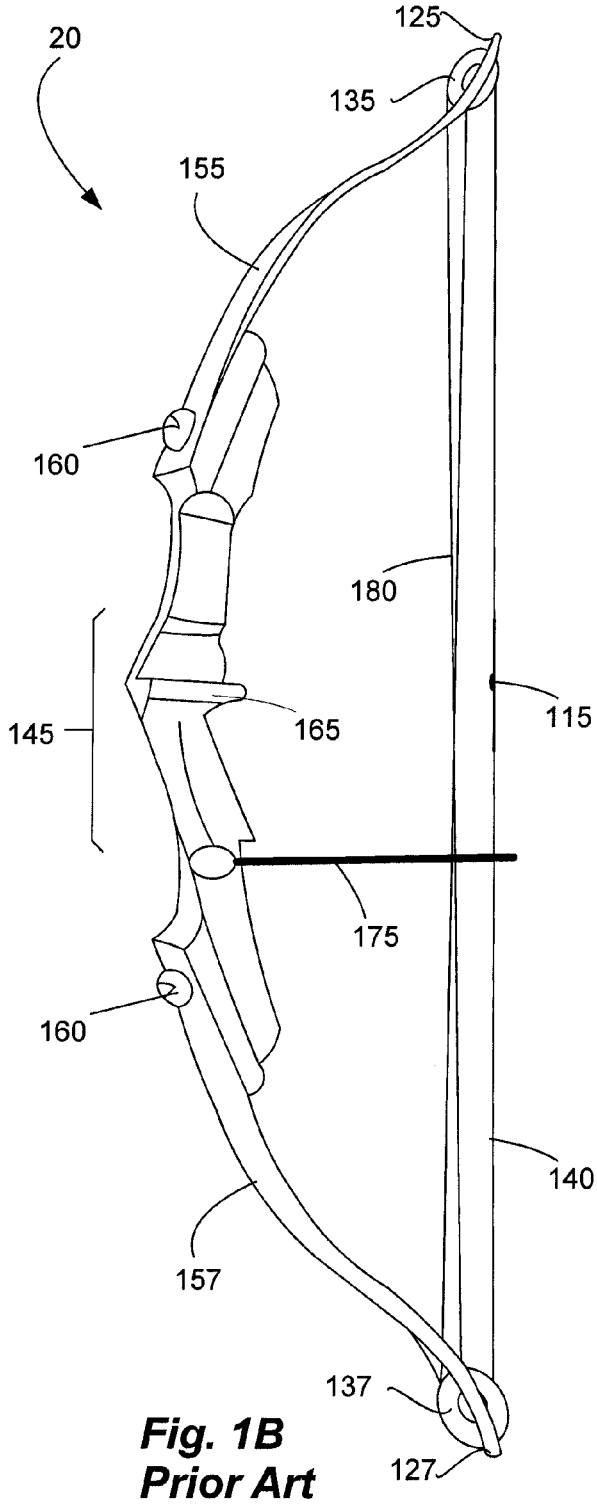
Fig. 1B Prior Art
FIG. 1B illustrates a traditional compound bow, according to one exemplary embodiment.

Similarly, FIG. 1B illustrates a compound bow (20) according to one exemplary embodiment. For several reasons described herein, a majority of bow hunters prefer compound bows (20) to recurve bows (10). The exemplary compound bow (20) includes a riser section (145) with a handle portion, an upper limb (155), a lower limb (157), and limb tips (125, 127) similar to the recurve bow (10). However, the compound bow (20) includes eccentrics (135, 137) on the ends (125, 127) of the limbs (155, 157). These eccentrics (135, 137) provide a mechanical leverage in drawing the bow (20). As the bowstring (140) is pulled back, the eccentrics (135, 137), in the form of cams, pulleys, etc., rotate and cause the attached bow cables (180) to bend the limbs (155, 157) inward. Additionally, the exemplary embodiment illustrated in FIG. 1B includes a cable guard (175). Similar to the recurve bow (10) the compound bow (20) includes an arrow rest (165) and an arrow nock (115). Pulling back the bowstring (140) causes the limbs (155, 157) to bend inward and store energy. By releasing the bowstring (140), the limbs (155, 157) will quickly return to their original position. In so doing, the limbs translate stored energy through the bowstring (140) to propel an arrow.

The eccentrics of compound bows provide a significant advantage because they allow for what is known as "let-off". "Let-off" is a point at which only a fraction of the originally applied force is required to maintain the limbs of the bow in a maximally bent shape. That is, a given bow may require, for example, a maximum of 70 pounds of force during draw, but only require 15 pounds of force to maintain the bow at full draw. Let-off is often measured as percentage of force that is no longer required to maintain the limbs in the maximally bent position. Thus, it might be said that a given compound bow has, for example, an 80% let-off.

Compound bows (20) are often preferred to recurve bows (10) for several reasons. A primary reason that compound bows are often preferred to recurve bows is the let-off. As illustrated in FIG. 1B, the compound bow comprises upper and lower limbs (155, 157) attached at attachment points (160) to a riser (145). While the compound bow (20) is arguably superior to the recurve (10), it suffers from several shortcomings. Eccentrics (135, 137) add weight to the limbs (155, 157), which decreases the overall efficiency. More energy is dissipated in returning the limbs (155, 157) to their original position after releasing the bowstring (140). Furthermore, the additional weight of the compound bow (20), due to the eccentrics (135, 137), increases the amount of recoil. In fact, many hunters utilize stabilizers to minimize this recoil. Stabilizers, while decreasing recoil, add weight to the overall system and potentially decrease efficiency even further. Additionally, the eccentrics (135, 137) require maintenance and produce additional noise. The present system and method provides all of the advantages of the compound bow while simultaneously increasing efficiency and reducing recoil, noise, and maintenance.

Figure 2A:
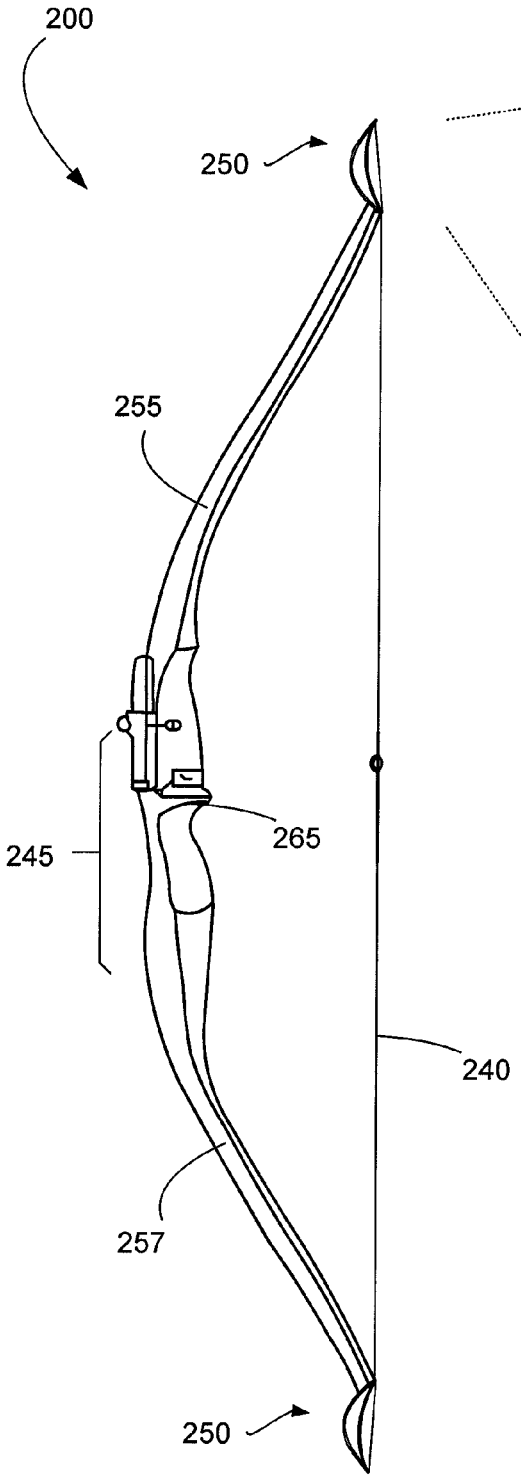
FIG. 2A illustrates a bow, according to one exemplary embodiment, including compression members positioned on the ends of each limb that extend outward.

FIG. 2A illustrates an exemplary bow configuration that eliminates a number of the shortcomings of prior art bows, while adding a number of advantages. While the present exemplary system and method are illustrated and described herein as being incorporated into a bow as shown in FIG. 2A, it will be understood that the present exemplary system may be incorporated into any number of archery systems including, but in no way limited to, bows, cross-bows, and the like. As used herein, the term "bow" shall be interpreted as including all compatible archery systems, regardless of size or general configuration. As illustrated in FIG. 2A, a number of compression members (250) are positioned on the ends of the upper (255) and lower (257) limbs of a bow (200), according to one exemplary embodiment. According to this embodiment, the compression members (250) are secured to the ends of the limbs (255, 257) and extend outward from the center of the radius of curvature of the bow (200), and extend away from the handle portion. As illustrated, the exemplary bow (200) further includes a riser (245), an arrow rest (265), and a bowstring (240), similar to those described in conjunction with FIG. 1A.

Figure 2B:
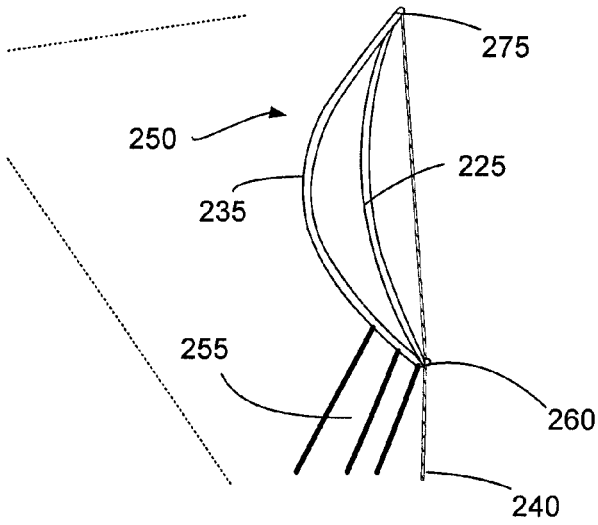
FIG. 2B is a close-up view of a compression member used in FIG. 2A, according to one exemplary embodiment.

FIG. 2B is a close-up view of the compression member (250) of FIG. 2A, according to one exemplary embodiment. As illustrated in FIG. 2B, the exemplary compression member (250) is positioned such that it is coupled to the tip of the limb (255). According to this exemplary embodiment, the bowstring (240) is slideably secured to the distal end (260) of the compression member (250). That is, the bowstring (240) is slideably connected to the distal end (260) of the compression member (250) and fully secured to the proximal end (275) of the compression member (250). According to one embodiment, a pulley or other eccentric is used to allow the bowstring (240) to easily slide at the distal end (260). Various alternative embodiments are possible, including utilizing a notch, loop, groove, eyelet, orifice, grommet, or other guide member to slideably secure the bowstring (240) to the compression member (250).

As is illustrated in FIG. 2B, according to one exemplary embodiment, the compression member comprises a primary compression element (235) and a secondary compression element (225). According to one exemplary embodiment, the primary compression element (235) has a larger radius of curvature than the secondary compression element (225), but the ends (275, 260) of both compression elements (235, 225) are connected at substantially the same point. Consequently, the compression elements form a crescent shape, as illustrated in FIG. 2B. Details regarding the shape and force-deflection characteristics of various compression members are provided below in conjunction with FIGS. 6A-6B.

As is illustrated in greater detail in conjunction with FIGS. 2A and 2B, drawing the bowstring (240) will compress the compression member (250). Specifically, according to this exemplary embodiment, the bowstring (240) attached to the proximal end (275) of the compression member (250) will pull the proximal end (275) of the compression member (250) downward and/or inward. The slidable connection of the bowstring (240) to the distal end (260) of the compression member (250) ensures that the force exerted on the compression member (250) is in a purely downward direction. Once compressed, the compression member (250) stores energy until the bowstring (250) is released, at which time the compression member (250) rapidly returns to its original position. The rapid expansion of the compression member (250) transfers energy to the bowstring (250) and thereby propels an arrow. The compression, expansion, and method by which energy is stored in the compression members (250) are described in greater detail below.

According to one exemplary embodiment, the limbs (255, 257) of the bow (200) are sufficiently resilient so as to resist any deflection as the bow (200) is drawn. That is, as the bow (200) is drawn, rather than storing energy in bending limbs (255, 257), all or nearly all of the input energy is stored in the compression members (250). According to an alternative embodiment, both the limbs (255, 257) and the compression members (250) store energy and are deflected as the bow is drawn.

Figures 3A, 3B:
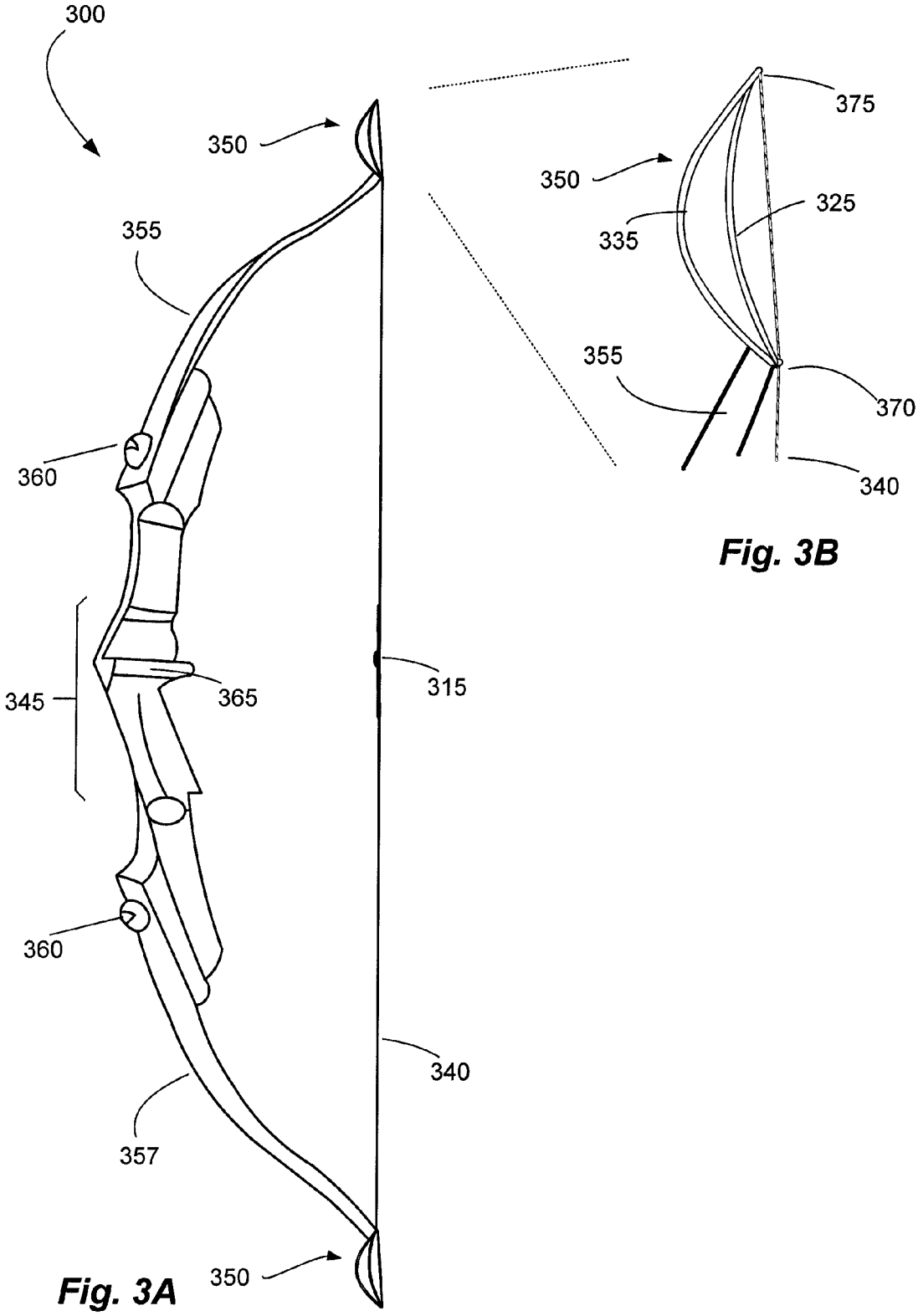
FIG. 3A illustrates a bow, according to another exemplary embodiment, including compression members positioned on the ends of each limb that extend outward.
FIG. 3B is a close-up view of a compression member used in FIG. 3A, according to one exemplary embodiment.

FIG. 3A illustrates a bow (300) utilizing compression members (350) extending outward from the bow's direction of curvature. Similar to the bow (20) of FIG. 1B, the bow (300) in FIG. 3A includes a riser portion (345), an upper (355) and a lower (357) limb connected at attachment points (360) to the riser (345), an arrow rest (365), and a bowstring (340) with an arrow nock (315). According to various embodiments, the limbs (355, 357) of the bow (300) can be detached from the riser (345) to improve portability. Otherwise, the functionality of the bow (300) is similar to that of the bow (200) in FIG. 2A.

FIG. 3B illustrates the open end of the upper limb (355) of the bow (300), according to one exemplary embodiment. As illustrated, a bowstring (340) is slideably attached to the distal end (370) and fixedly attached to the proximal end (375) of the compression member (350). Consequently, as the bowstring (340) is pulled the proximal end (375) of the compression member (350) is compressed downward and/or inward. The compression elements (335, 325), or proximal ends thereof, will deflect downward and/or inward, decreasing the radius of curvature of both elements (335, 325). The compression member (350) stores the energy as the bowstring (340) is drawn and rapidly returns the energy to the bowstring (340) when released. According to one exemplary embodiment mentioned previously, the limbs (355, 357) are resilient to any deformation. Consequently, as the bow (300) is drawn, the limbs (355, 357) will not flex nor store any energy. The compression members (350) store all the energy used to propel the arrow. According to an alternative embodiment, the limbs (355, 357) deform slightly and, therefore, store a portion of the energy returned to the bowstring (340) upon release.

Figures 4A, 4B, 4C:
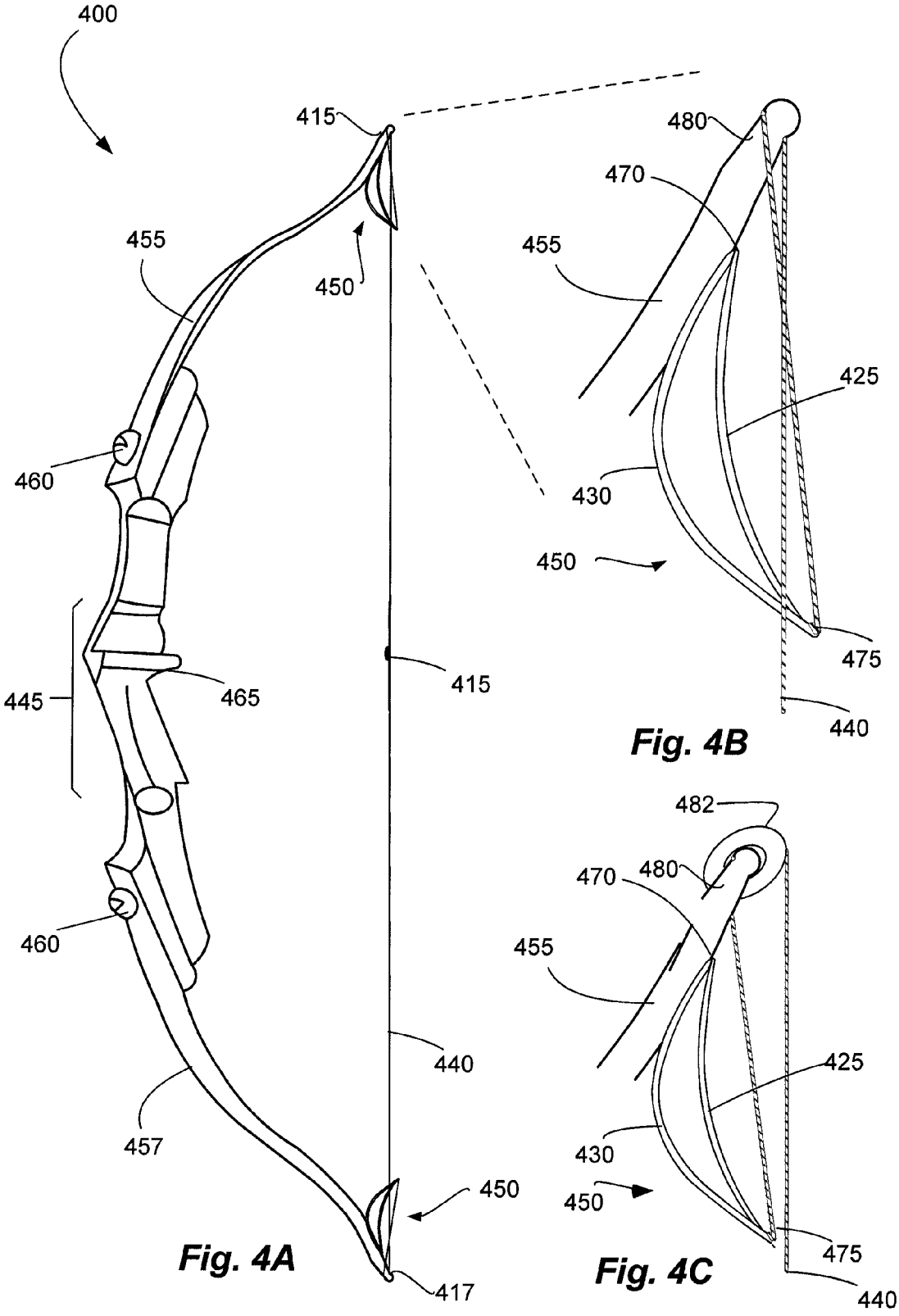
FIG. 4A illustrates a bow including compression members positioned on the ends of each limb extending inward, according to one exemplary embodiment.
FIG. 4B illustrates a close-up view of a compression member in FIG. 4A, according to one exemplary embodiment.
FIG. 4C illustrates a close-up view of a compression member in FIG. 4A, according to one exemplary embodiment.

FIG. 4A illustrates another exemplary embodiment wherein compression members (450) extend inward from the open ends of the limbs (455, 457) of a bow (400) and extend toward the handle portion. According to this embodiment, the general design of the bow (400) is similar to the previous bows (20, 300) in that it comprises a riser (445), upper (455) and lower (457) limbs removably secured to the riser (445) at attachment points (460), an arrow rest (465), and a bowstring (440) including an arrow nock (415). Alternatively, the riser (445) and the upper (455) and lower (457) limbs may be formed as one piece. Significantly different from the bow (300) in FIG. 3A is the positioning of the compression members (450) and the manner in which the drawing of the bowstring (440) compresses them.

As is illustrated in FIG. 4B, according to one exemplary embodiment, the compression member (450) is inverted from the compression member (350) in FIG. 3B and extends inward from the open end of the upper limb (455). The bowstring (440) passes around the tip (480) and then extends downward to attach to the proximal end (475) of the compression member (450). The distal end (470) of the compression member (450) is secured to the underside of the upper limb (455) of the bow (400). The tip (480) acts as a pulley, allowing a downward pull on the bowstring (440) to be translated around the tip (480) to pull the proximal end (475) of the compression member (450) toward the tip (480). In fact, according to various embodiments, the tip (480) includes a pulley or other eccentric to aid in translating the force around the tip (480). According to alternative embodiments, the tip (480) allows the bowstring (440) to pass through an orifice, an eyelet, a loop, or through the tip (480) itself. According to another alternative embodiment, the bowstring (440) passes through a groove formed in the tip (480) of the limb (455).

As illustrated in FIG. 4C, according to one exemplary embodiment, the bowstring (440) passes around a pulley or other eccentric (482) at the tip (480) and then extends downward to attach to the proximal end (475) of the compression member (450). The distal end (470) of the compression member (450) is secured to the underside of the upper limb (455) of the bow (400). The tip (480) acts as a pulley, allowing a downward pull on the bowstring (440) to be translated around the tip (480) to pull the proximal end (475) of the compression member (450) toward the tip (480). The pulley or other eccentric can aid in translating the force around the tip (480).

Though the use of a circular, elliptical, or other eccentric may appear very similar to traditional compound bows (see FIG. 1B), a significant advantage is attained partially because the weight of the eccentrics does not affect the operation of the bow. Traditional compound bows position eccentrics at the ends of the limbs of compound bows. Therefore, the weight of the eccentrics is added to the weight of limbs in calculating the wasted energy required to return the limbs to their static position. According to the present system and method exemplified in FIGS. 4A and 4B, an eccentric positioned on the tip (480) will not add weight to the compression member (450) nor aid in flexing the limbs of the bow. According to one embodiment, only the compression member (450) is deformed and only the compression member (450) stores energy as the bow (400) is drawn. Consequently, when the bowstring (440) is released, nearly 100% of the energy stored within the compressed compression members (450) is returned to the bowstring (440). Should the tip (480) include a pulley or other eccentric, as it does according to various embodiments, the energy would be translated at the efficiency of the eccentric, which would likely approach 100%.

Similar to the previous embodiments, the compression member (450) in FIG. 4B comprises a primary compression element (430) and a secondary compression element (425). The arcuate compression elements form a crescent shape where the primary compression element (430) has a smaller radius of curvature than the secondary compression element, but the endpoints of each are at least approximately joined. Details regarding the force-deflection and configurations of the compression members are provided in conjunction with FIGS. 6A-6B.

Figure 5A:
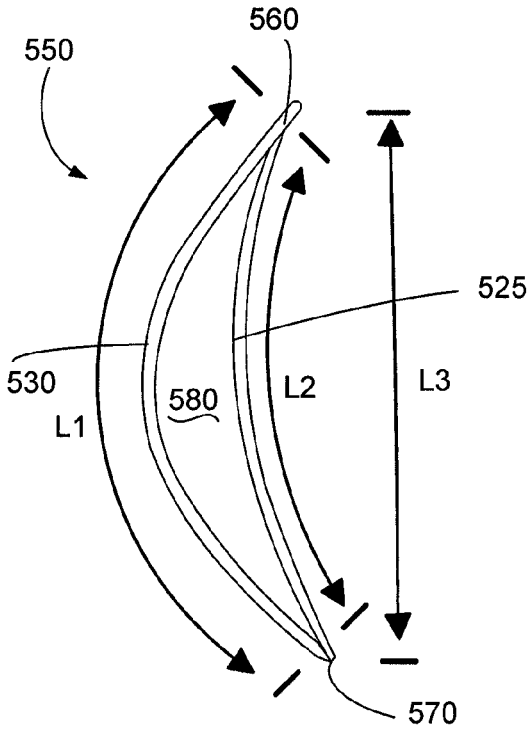
FIGS. 5A-5C illustrate the characteristics of exemplary compression members comprising one or more compression elements, according to various embodiments.

FIG. 5A illustrates a compression member (550), according to one exemplary embodiment. The compression member (550) includes a proximal end (560) and a distal end (570). A chord length (L3) illustrates the distance between the distal (570) and proximal (560) ends when the compression member (550) is at rest in a static position. A secondary arc length (L2) represents the arc length of the secondary compression element (525) and a primary arc length (L1) is the arc length of the primary compression element (530).

According to one exemplary embodiment, as illustrated in FIG. 5A, the arc length (L1) of the primary compression element (530) is greater than the arc length (L2) of the secondary compression element (525). Yet both the primary (530) and secondary (525) elements have approximately the same chord length (L3) and the ends of both elements (530, 525) are joined together. Consequently, the joining of the primary (530) and secondary (525) elements forms a crescent (580). According to various embodiments, the primary (530) and secondary (525) elements are joined at their ends by any number of means, including fasteners, welds, adhesives, fusing, and other joining methods. According to one exemplary embodiment the two elements (530, 525) are formed as a single compression element; consequently, no joining is necessary because the compression member (550) comprises a single element.

According to one exemplary embodiment, the primary compression element (530) is formed of a composite material including a fiber in a resin matrix. For example, the primary compression element (530) can be formed of carbon fibers, fiberglass, and the like, with a resin such as epoxy. The composite material can be shaped to form the arc (L1) of the primary compression element (530). That is, the primary compression element (530), according to one exemplary embodiment, includes a fiber and resin based curvilinear spring member that is flexible to store energy and resilient to return energy. According to alternative embodiments, the compression elements may be formed of any number of materials, including metals, plastics, rubbers, and other synthetic materials resilient to store and return energy.

According to one exemplary embodiment, the ends of the secondary compression element (525) are secured to the ends of the primary compression element (530). According to alternative embodiments, at least one of the ends of the secondary compression element (525) is secured to the primary compression element (530) at a location other than the primary compression element's end.

Similar to the primary compression element (530), the secondary compression element (525), according to one exemplary embodiment, comprises a composite material with fiber in a resin matrix. For example, the secondary compression element (525) can be formed of carbon fibers, fiberglass, and the like, with a resin such as epoxy. The composite material can be shaped to form the arc (L2) of the secondary compression element (525) and can form a curvilinear spring member that is flexible to store energy and resilient to return energy.

Figure 5B:
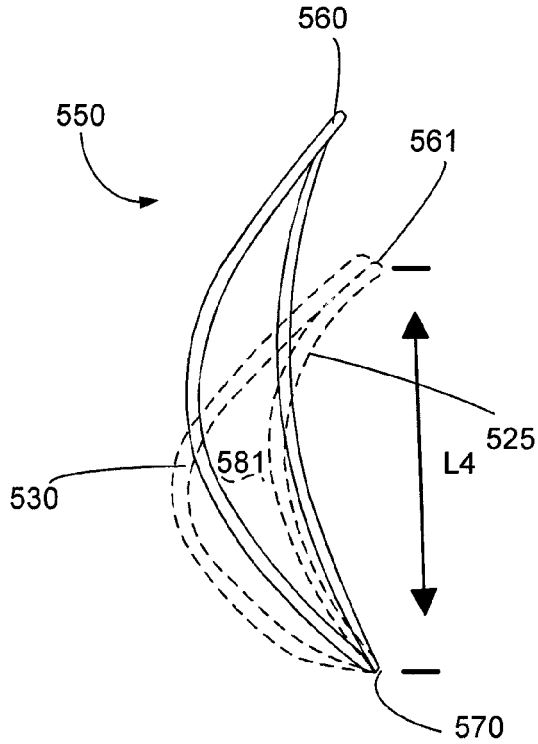
Figure 5C:
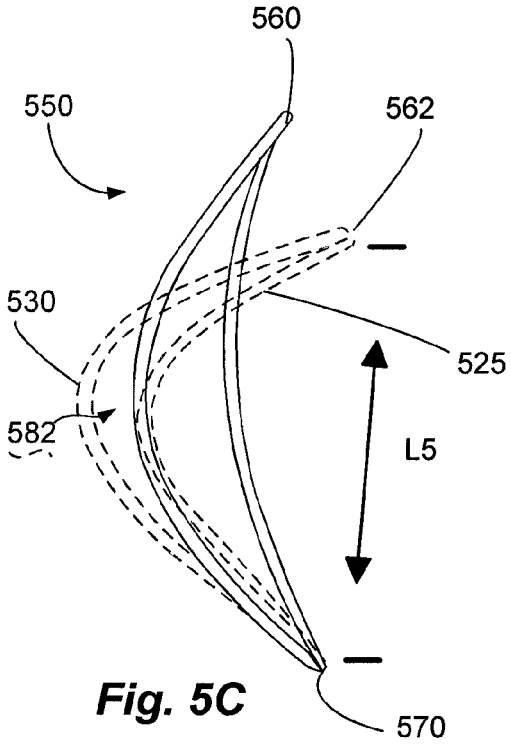

According to one exemplary embodiment, the secondary compression element (525) has a shorter arc length (L2) than the primary compression element (530). As previously described, a crescent (580) is thereby formed in the middle of the compression elements (530, 525). As illustrated in FIGS. 5B and 5C, as the compression member (550) is compressed, the lengths (L1, L2) of the elements (530, 525) remain constant, while the chord length (L3) is shortened and the crescent (580) changes shape.

FIG. 5B illustrates the compression member (550) of FIG. 5A as well as a compressed compression member (550) illustrated in dashed lines, according to one exemplary embodiment. Illustrated in dashed lines, when the compression member (550) is compressed, the primary (530) and secondary (525) compression elements are deflected downward. The original location of the proximal end (560) is relocated to the proximal end (561) of the dashed representation. Furthermore, the crescent (580) of FIG. 5A is shown compressed (581) in FIG. 5B. While compressed, the chord length (L4) is decreased. Due to the energy characteristics of the compression member (550), the compressed compression member (dashes) stores energy and is resilient to return energy.

FIG. 5C illustrates, in dashes, further compression of the compression member (550), according to one embodiment. The proximal end (560) is compressed downward (562), creating a shorter cord length (L5). Comparing FIGS. 5B and 5C it can be seen that, according to one exemplary embodiment, depending on the amount of compression, the shape of the crescent (580) is different (compare 581, FIG. 5B; and 582, FIG. 5C). According to various embodiments, the compression elements (525, 530) form a crescent (580) that acts as a spring that stores and returns energy.

It will be appreciated that each compression element (525, 530) forming the crescent (580) can have different spring characteristics. For example, the primary compression element (530) can have a linear or constant force-to-deflection ratio such that the primary compression element (530) can deflect by a constant proportional amount with respect to any given applied force. Additionally, the secondary compression element (525) can have a non-linear or variable force-to-deflection ratio such that the secondary compression element (525) can deflect by a smaller amount with a smaller applied force, and a disproportionately larger amount with a larger applied force. According to one exemplary embodiment, the non-linear force-deflection ratio of the secondary compression element (525) increases the amount of deflection non-linearly with increased applied force up to an upper deflection limit, at which point the amount of deflection can decrease even when the applied force continues to increase. In this way, the secondary compression element (525) can increase the overall stiffness of the compression member (550) as the amount of deflection in the secondary compression element (525) increases. According to one embodiment, at a given deflection limit, significantly less force is required to maintain the compression member (550) in that compressed state; this enables the let-off previously described.

Figure 6A:
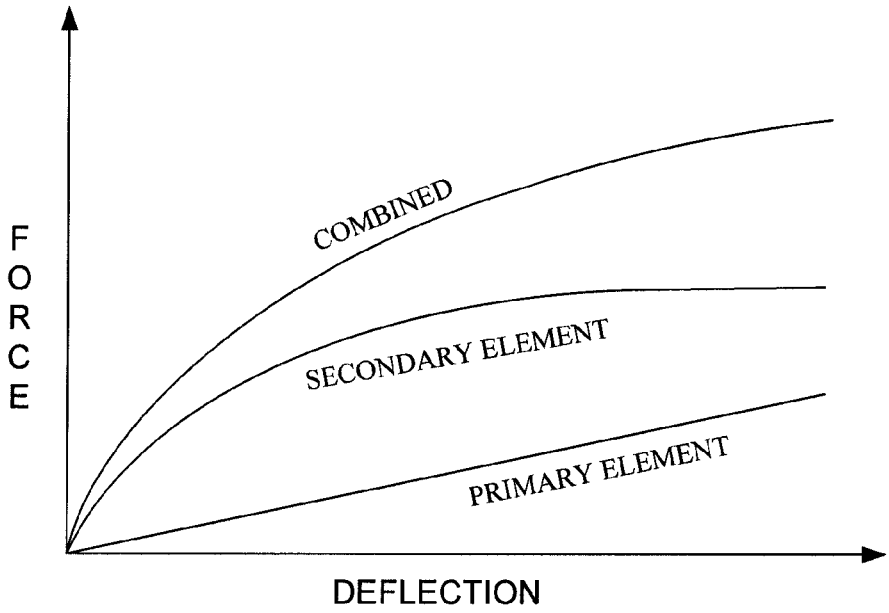
FIG. 6A is a force deflection graph illustrating the energy storage characteristics of the present exemplary compression members, according to one exemplary embodiment.

FIG. 6A provides a graphical representation of exemplary force-deflection characteristics of the primary compression element (530), secondary compression element (525), and the overall compression member (550), according to one exemplary embodiment. According to various alternative embodiments, the force deflection curves are all linear, all non-linear, and/or any combination of linear and non-linear. The materials, construction, and configuration of the compression elements (525, 530) as well as the number of compression elements can widely influence the force-deflection characteristics of the compression member (550). It should be recognizable that for different applications and specific performance any desired characteristic may be easily achieved. Consequently, while FIGS. 6A-6B illustrate these configurations and characteristics according to several embodiments, many variations are possible, and with minimal calculation can be achieved through variations in the structure, shape, and/or configurations.

Returning to the exemplary force-deflection graph in FIG. 6A, the primary element is shown having generally linear force-deflection characteristics and the secondary element having non-linear characteristics. The representation labeled "Combined" illustrates the overall force-deflection characteristics of one exemplary compression member (550, FIG. 5A-5C). As previously noted, the specific characteristics are easily modifiable and can be tailored to specific needs.

Figure 6B:
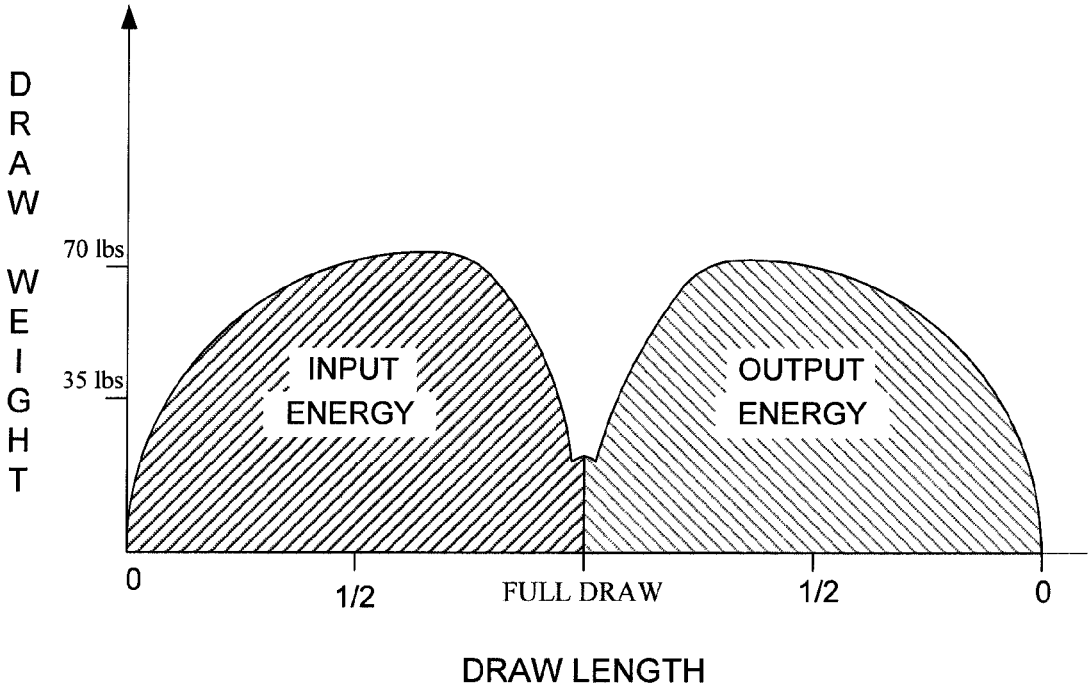
FIG. 6B is a graph illustrating the draw weight as a function of draw length of the present system, according to one exemplary embodiment.

FIG. 6B illustrates the draw length versus draw weight as well as the energy input and output, according to one exemplary embodiment. It should be apparent to those skilled in the art that graphical representation of FIG. 6B is merely according to one example and only an estimation. Various alternative embodiments and configurations result in substantially different characteristics. It should be understood that while FIG. 6B represents one possibility, in no way does it limit the scope of alternative configurations, nor is it intended to represent the actual characteristics of the preferred embodiment.

Reading FIG. 6B from left to right, beginning at the pointed marked "0" it can be seen that at 0-draw there is obviously no weight required to maintain the bowstring. As we approach ½-draw nearly 70 lbs. of force is required to maintain the bowstring in that position. According to one embodiment, a peak weight requirement is located at about ¾-draw where just over 70 lbs. of force is required to maintain the bowstring in that position. However, as the bowstring is drawn from ¾-draw to full-draw it can be seen the required amount of force decreases significantly. In fact, near full-draw only a fraction of the peak draw weight is required. This is a graphical representation of the previously described let-off. The area under the curve represents the total energy input into the compression members (450, FIG. 4A) and stored therein.

Continuing from right to left, at full-draw all the shaded area to the left represents the stored energy (input energy). Once the bowstring (440, FIG. 4A) is released the curve to the right of full-draw represents the energy being returned from the compression members (450, FIG. 4A) to the bowstring (440), which in turn propels the arrow. The returned energy (Output Energy) is nearly symmetric to the Input Energy. In fact, in a 100% efficient system the two curves (Input and Output Energy) would be identical.

According to various exemplary embodiments and as previously stated, all the stored energy (Input Energy) is stored within the compression members (450, FIG. 4A). That is, the limbs (455, 457) of the bow are configured to resist any deformation as the bowstring (440) is drawn. As previously noted, this exemplary configuration provides substantial advantages over traditional systems. Upon release of the bowstring (440), only the weight of the compression members (450) must return to a static state. In contrast, traditional designs require the weight of the limbs as well as any eccentrics to return to static state, decreasing the overall efficiency of traditional systems.

As illustrated in FIG. 6B, according to at least one exemplary embodiment, the bow has a let-off after a peak force requirement. According to various embodiments, this let-off is a characteristic of the compression members (550, FIG. 5A-5C). The material, construction, and configuration of the compression elements (525, 530) are manipulated to achieve the desired amount of let-off. According to an alternative embodiment, the let-off is not a function of the compression members (550), but rather is achieved using pulleys or other eccentrics similar to traditional compound bows. According to this exemplary embodiment, eccentrics are positioned at the ends of both limbs and the bowstring actuates the eccentrics, which in turn compress the compression members by actuating a cable or other mechanical member. Even though, according to this embodiment, eccentrics are used to achieve let-off, significant advantage is still attained. Again, only the relatively small, light compression members are deformed during draw. Consequently, when the bowstring is released, less energy is wasted in returning the energy storage elements to static state than is needed in traditional systems where the limbs and eccentrics weigh more and travel a greater distance to return to a static state.

Figure 7A:
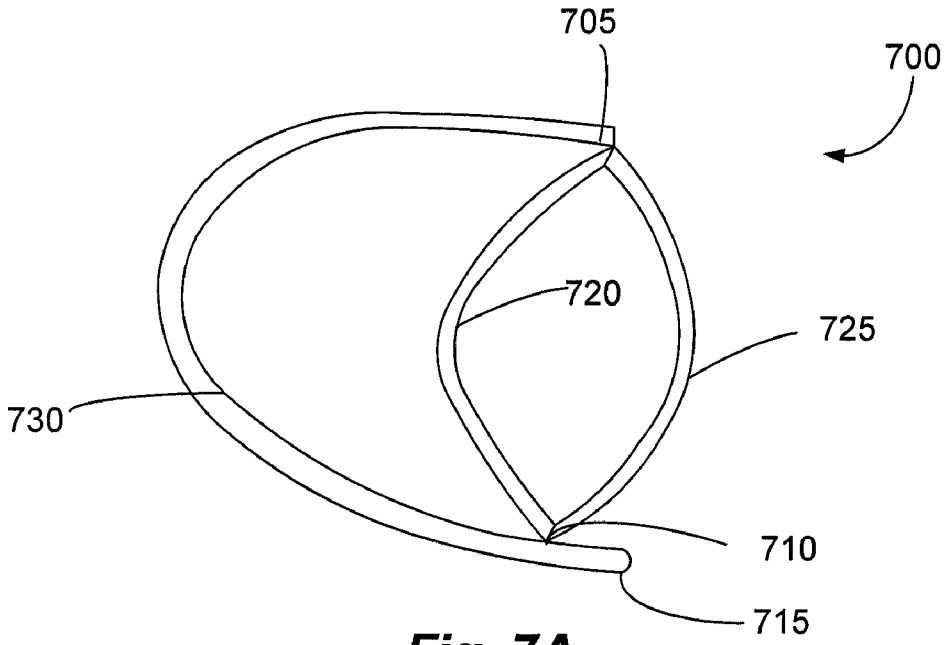
FIGS. 7A & 7B illustrate alterative embodiments of compression members, according to various embodiments.
Figure 7B:
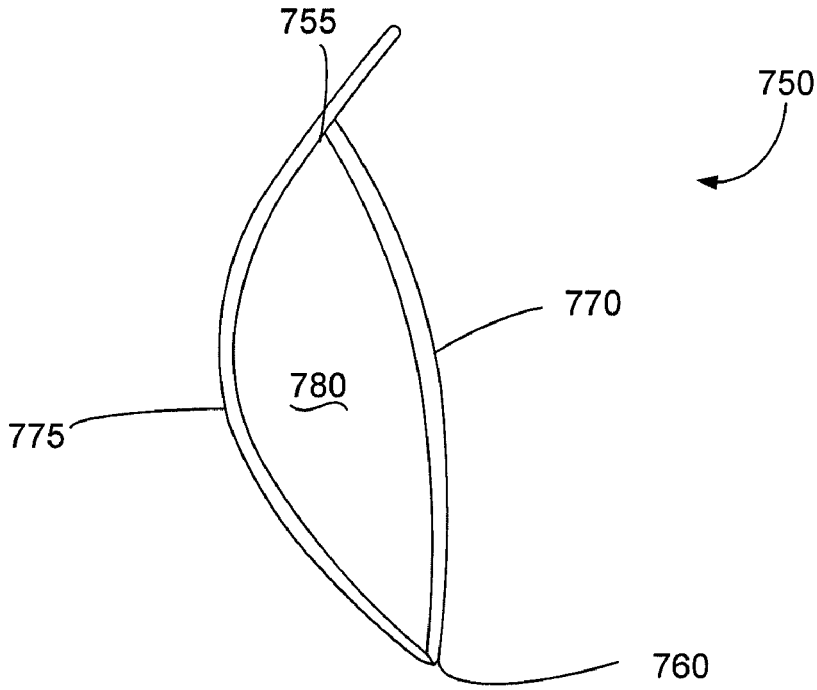

FIGS. 7A and 7B illustrate compression members (700, 750) according to various alternative embodiments. As illustrated in FIG. 7A, according to one exemplary embodiment, a compression member (700) includes a primary compression element (730) and a secondary compression element (720) similar to previously described compression members (see FIG. 5A). However, as depicted in FIG. 7A, the alternative embodiment also includes a tertiary compression element (725). Each of the compression elements (730, 725, 720) forms an arc in a static position. According to various embodiments the arc length of each may vary as well as the radius of curvature. However, according to several embodiments, the ends of each of the elements (330, 725, 720) may be connected in substantially the same location. According to one embodiment, as depicted in FIG. 7A, at the proximal end (705) all three elements are connected together, while at the distal end (710) only the secondary (720) and the tertiary (730) compression elements are joined and the primary compression element (730) continues past the distal end point (710) to an attachment point (715).

According to one exemplary embodiment, the distance between the attachment point (715) and the distal end point (710) partially defines the characteristics of the compression member (700). The addition of a tertiary compression element (725) provides increased resistance to compression as well as an increased capacity to store and return energy. According to various embodiments, each of the compression elements (730, 725, 720) may have linear or non-linear force-deflection characteristics and may be configured to achieve certain desired characteristics.

Furthermore, each of the compression elements (730, 725, 720) may be formed of a composite material with fiber in a resin matrix. For example, the compression elements (730, 725, 720) can be formed of carbon fibers, fiberglass, and the like, with a resin such as epoxy. The composite material can be shaped to form any desired arcuate shape. That is, the compression member (700), according to one exemplary embodiment, can include a fiber and resin based curvilinear spring with secondary (720) and tertiary (725) elements that are flexible to store energy and resilient to return energy. According to alternative embodiments, any number of compression elements may be used to form a compression member.

FIG. 7B illustrates another alternative embodiment including a primary compression element (775) and a secondary compression element (770) defining an oval like area (780). According to this embodiment, the primary compression element (775) and the secondary compression element (770) are both curvilinear. However, according to one exemplary embodiment, the primary compression element (775) and the secondary compression element (770) curve toward each other and thereby form an oval (780) rather than a crescent. According to this alternative embodiment, the ends of each element (775, 770) may be joined as the distal end (760) illustrates, or the elements may be joined at a location other than the endpoints as is illustrated on the proximal end (755). The compression elements, according to various embodiments, comprise a composite material with fiber in a resin matrix. Alternatively, the compression elements may comprise of any number of materials known to be resilient to store and return energy.

Figure 8A:
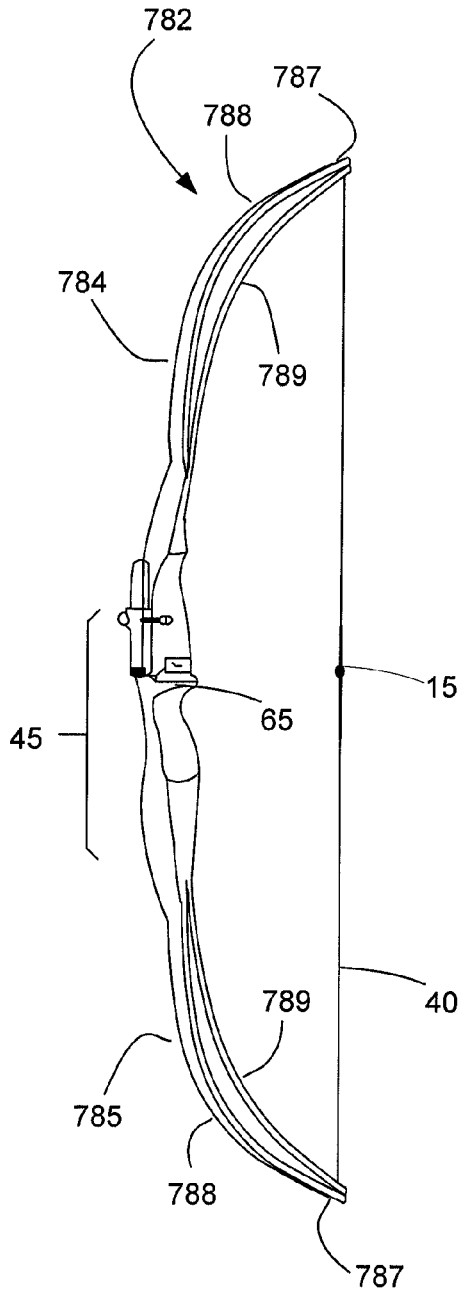
FIG. 8A illustrates a bow, according to one exemplary embodiment, including compression members.

FIG. 8A illustrates another exemplary embodiment in which the bow (782) has first and second, or upper and lower, compression members (784, 785) in place of upper and lower limbs. According to this embodiment, the compression members (784, 785) are secured to, or extend from, the ends of the riser (786). As illustrated, the exemplary bow (782) further includes a riser (786), an arrow rest (65), and a bowstring (40), similar to those described in conjunction with FIG. 1A. The compression members (784, 785) are positioned such that they are coupled to the ends of the riser (786). According to this exemplary embodiment, the bowstring (40) is secured to the proximal ends (787) of the compression members. Various alternative embodiments are possible, including utilizing eccentrics, cams, pulleys, etc.

According to one exemplary embodiment, the compression members comprise a primary compression element (788) and a secondary compression element (789). According to one exemplary embodiment, the primary compression element (788) has a larger radius of curvature than the secondary compression element (789), but the ends of both compression elements are connected at substantially the same point. Consequently, the compression elements form a crescent shape. Details regarding the shape and force-deflection characteristics of various compression members are provided below in conjunction with FIGS. 6A-6B.

Drawing the bowstring (40) will compress the compression members (784, 785). Specifically, according to this exemplary embodiment, the bowstring (40) attached to the proximal ends (787) of the compression members (784, 785) will pull the proximal ends (787) of the compression members (784, 785) inward. Once compressed, the compression members store energy until the bowstring is released, at which time the compression members rapidly return to their original position. The rapid expansion of the compression members transfers energy to the bowstring and thereby propels an arrow.

According to one exemplary embodiment, the compression elements (788, 789) are formed of a composite material including a fiber in a resin matrix. For example, the compression elements (788, 789) can be formed of carbon fibers, fiberglass, and the like, with a resin such as epoxy. The composite material can be shaped to form the arc of the compression elements. That is, the compression elements, according to one exemplary embodiment, includes fiber and resin based curvilinear spring members that are flexible to store energy and resilient to return energy. Similarly, the riser (786) can also be formed of a composite material including a fiver in a resin matrix. According to alternative embodiments, the compression elements may be formed of any number of materials, including metals, plastics, rubbers, and other synthetic materials resilient to store and return energy.

According to one exemplary embodiment, the ends of the secondary compression element (789) are secured to the ends of the primary compression element (788). According to alternative embodiments, at least one of the ends of the secondary compression element (789) is secured to the primary compression element (788) at a location other than the primary compression element's end.

Figure 8B:
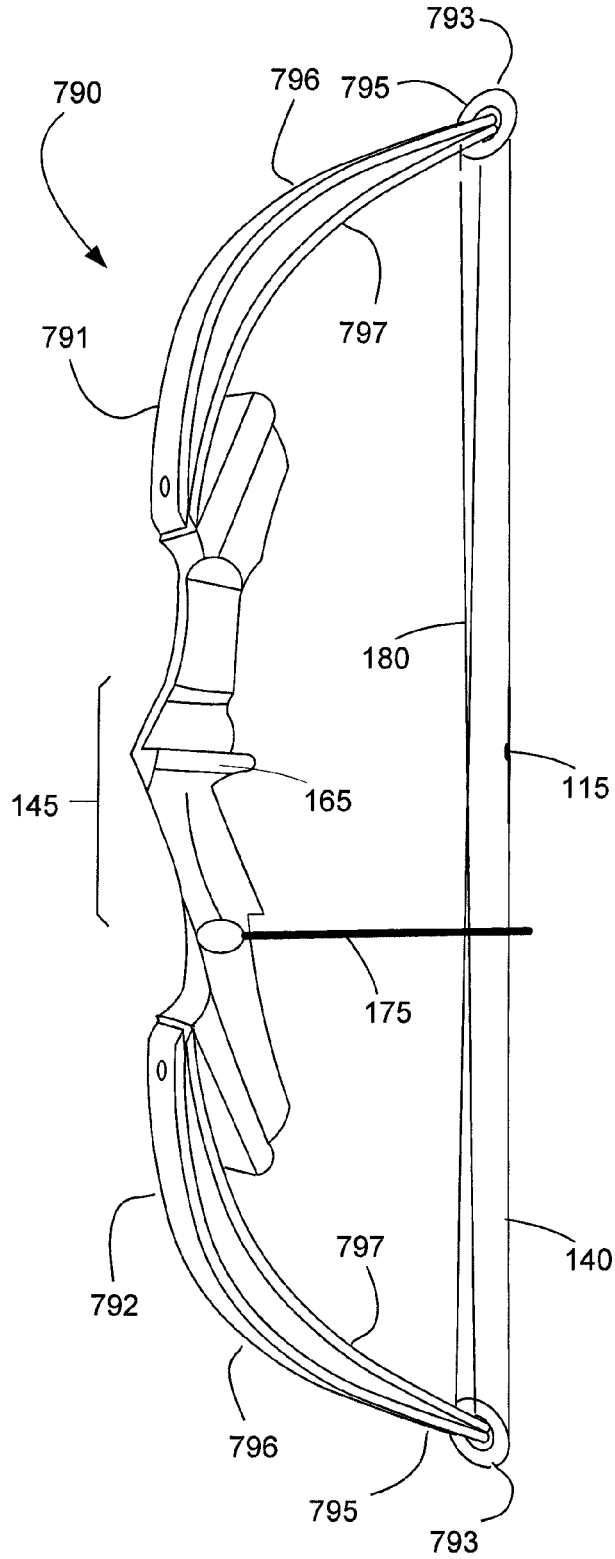
FIG. 8B illustrates a bow, according to one exemplary embodiment, including compression members.

FIG. 8B another exemplary embodiment in which the bow (790) has first and second, or upper and lower, compression members (791, 792) in place of upper and lower limbs. Similar to the bow (20) of FIG. 1B, the bow (790) in FIG. 8B includes a riser portion (793), an arrow rest (165), and a bowstring (140) with an arrow nock (115). According to various embodiments, the compression members (791, 792) of the bow (790) can be attached at attachment points (160) to the riser (793), and can be detached from the riser (793) to improve portability. Otherwise, the functionality of the bow (790) is similar to that of the bow (20) in FIG. 1B.

The bow (790) includes eccentrics (793, 794) on the ends (795) of the compression members (791, 792). These eccentrics (793, 794) provide a mechanical leverage in drawing the bow. As the bowstring (140) is pulled back, the eccentrics (793, 794), in the form of cams, pulleys, etc., rotate and cause the attached bow cables (180) to bend the compression members (791, 792) inward. Additionally, the exemplary embodiment illustrated includes a cable guard (175). The bow (790) includes an arrow rest (165) and an arrow nock (115). Pulling back the bowstring (140) causes the compression members (791, 792) to bend inward and store energy. By releasing the bowstring (140), the compression members (791, 792) will quickly return to their original position. In so doing, the compression members (791, 792) translate stored energy through the bowstring (140) to propel an arrow.

According to one exemplary embodiment, the compression members comprise a primary compression element (796) and a secondary compression element (797). According to one exemplary embodiment, the primary compression element (796) has a larger radius of curvature than the secondary compression element (797), but the ends of both compression elements are connected at substantially the same point. Consequently, the compression elements form a crescent shape. Details regarding the shape and force-deflection characteristics of various compression members are provided below in conjunction with FIGS. 6A-6B.

Drawing the bowstring (140) will compress the compression members (791, 792). Specifically, according to this exemplary embodiment, the bowstring (140) attached to the proximal ends (795) of the compression members (791, 792) will pull the proximal ends (795) of the compression members (791, 792) inward. Once compressed, the compression members store energy until the bowstring is released, at which time the compression members rapidly return to their original position. The rapid expansion of the compression members transfers energy to the bowstring and thereby propels an arrow.

According to one exemplary embodiment, the compression elements (791, 792) are formed of a composite material including a fiber in a resin matrix. For example, the compression elements (791, 792) can be formed of carbon fibers, fiberglass, and the like, with a resin such as epoxy. The composite material can be shaped to form the arc of the compression elements. That is, the compression elements, according to one exemplary embodiment, includes fiber and resin based curvilinear spring members that are flexible to store energy and resilient to return energy. Similarly, the riser (793) can also be formed of a composite material including a fiver in a resin matrix. According to alternative embodiments, the compression elements may be formed of any number of materials, including metals, plastics, rubbers, and other synthetic materials resilient to store and return energy.

Exemplary Method

FIGS. 9A-12B illustrate a bow (800) utilizing the present exemplary compression member (850), according to one exemplary embodiment. FIGS. 9A, 10A, 11A, and 12A illustrate a complete bow (800), while FIGS. 9B, 10B, 11B, and 12B illustrate close-up views of the tip (880) of the upper limb (855), the compression member (850), and its interaction with the bowstring (840), according to exemplary embodiments. It will be recognized that the bow (800) described is similar to the bow (400) illustrated in FIG. 4. Also, the exemplary compression member (850) is similar to the compression member (550) described in FIGS. 5A-5C.

FIG. 9A illustrates a bow (800) including a riser section (845) secured to a lower limb (857) and an upper limb (855) as well as a bowstring (840). Compression members (850) are secured to the tips (880, 817) of each limb (855, 857). FIG. 9A illustrates the bow (800) in a static position. That is, the bowstring (840) is not drawn, the compression members (850) are not compressed, and no retrievable energy is being stored in the system. The close-up view provided in FIG. 8B illustrates clearly the bowstring (840) extending upward, wrapping around the tip (880) of the upper limb (855) of the bow (800) and then being secured to the end of the compression member (850). As illustrated, the bowstring (840) merely wraps around the tip (880). However, as has been previously discussed, the bowstring, according to alternative embodiments, may pass through or around various features located at the tip (880) of the limb (855) or may actuate eccentrics that ultimately serve to compress the compression member (850). In the static position illustrated in FIG. 9B the bowstring is taut, but does not exert sufficient force to compress the compression member (850).

FIG. 10A illustrates the bowstring (840) partially drawn, according to one exemplary embodiment. The bowstring (840) is pulled with a force (F) away from the riser (845) and is illustrated as being slightly arcuate. FIG. 10B illustrates the effects of the force (F, FIG. 10A) on the bowstring (840). In FIG. 9B the bowstring (840) is slightly arcuate and an arrow (1) indicates the downward force on the bowstring (840). The force (1) on the bowstring, translated around the tip (880), compresses the compression member (850). As the compression member (850) is compressed, energy is stored in the compression elements (830, 825), as they are each resilient to store and return energy.

FIG. 11A illustrates the bowstring (840) drawn by a force (F'), according to one exemplary embodiment. According to various exemplary embodiments, the bowstring (840) could be drawn further, storing more energy and compressing the compression member (850) even further. The close-up view of FIG. 11B shows an even more arcuate shaped bowstring (840) that acts to compress the compression member (850) even further. In this state the compression members (850) store a significant amount of energy. According to one embodiment, drawn to the state illustrated in FIG. 10B, a maximum amount of force is required to maintain the compression member in this position. This state would correspond to a little more than ½-draw in FIG. 6B. By drawing the bowstring (840) further, let-off is reached and the bow can be maintained at full-draw with significantly less force.

As mentioned previously, the present exemplary compression member (850) exhibits let-off as the compression member is compressed by a full draw of the bowstring (840). According to one exemplary embodiment, the structure and shape of the compression member (850) itself provides the let-off. Specifically, as the bowstring (840) is initially drawn from its static position illustrated in FIG. 9A to just over ½-draw as shown in FIG. 11A, the force required to compress the compression member (850) increases. According to one exemplary embodiment, the exemplary compression member (850) approaches the function of a bi-stable system. That is, after just over ½-draw, the force required to maintain the deflection of the compression member (850) decreases, thereby providing an increasing let-off until the bow is at full draw, without allowing the compression member to reach a second stable state. That is, the compression member (850) is not allowed to reach a second stable position wherein 100% let-off would be achieved and the bow would not fire.

When the bowstring is released, as illustrated in FIGS. 12A and 11B according to one exemplary embodiment, the compression members (850) rapidly return to their static state. Three arrows in FIG. 12A represent the rapid release of energy from the compression member (850) to the bowstring (840), causing the bowstring to thrust toward the riser (845) at a high velocity. The rapid movement of the bowstring (840) propels an arrow forward at a high velocity. FIG. 12B shows a close-up of the compression member (850) after returning to static state. It should be noted that at no time during this process were the limbs (855, 857) substantially deformed. Substantially all of the energy input from drawing the bowstring (840) was stored in the compression members (850) located at the ends of the upper (855) and lower (857) limbs. As the bowstring (840) was drawn, energy was stored in the resilient compression members (850) and eventually rapidly released to the bowstring. According to various embodiments, the let-off is a function of the characteristics of the compression members (850). According to alternative embodiments, the let-off is created using eccentrics.

In conclusion, the present system provides a method of storing and returning energy through compression members secured to a bow. More specifically, the compression members provide adequate let-off at near full-draw, minimize recoil, and are nearly silent. The present system is superior to traditional systems that require energy to be stored in the limbs of a bow as they are deformed. Less noise is produced, as according to one embodiment, no eccentrics are used and less movement is required. Greater efficiency is achieved because the compression members are lighter and travel a short distance between draw and release. Additionally, the overall weight of the system is reduced as the limbs of the present bow need not be specifically configured to store and return energy, only sufficiently rigid to resist deformation during draw.

The preceding description has been presented only to illustrate and describe exemplary embodiments of the present system and method. It is not intended to be exhaustive or to limit the system and method to any precise form disclosed. Many modifications and variations are possible in light of the above teaching. It is intended that the scope of the system and method be defined by the following claims.

What is claimed is:

1. A bow comprising:

a handle portion;

a first compression member coupled to said handle portion;

a second compression member coupled to said handle portion; and a bowstring coupled to said first compression member and said second compression member, wherein said bowstring is configured to compress said first and second compression members when drawn;

wherein said first and second compression members each include:

a primary compression element having a first and second end, wherein said primary compression member is in the form of an arc having a first radius of curvature; and at least one secondary compression element having a first and second end, wherein said secondary compression member is in the form of an arc having a second radius of curvature, said first and second radius of curvature being different;

wherein said first and second ends of said primary compression element are joined to said first and second ends of said secondary compression element respectively.

2. The bow of claim 1, further comprising:

an upper limb member having a proximal end and a distal end, said distal end of said upper limb member being coupled to said handle portion, said proximal end of said upper limb member extending up from said handle portion and coupled to said first compression member; and a lower limb member having a proximal end and a distal end, said distal end of said lower limb member being coupled to said handle portion, said proximal end of said lower limb member extending down from said handle portion and coupled to said second compression member.

3. The bow of claim 2, wherein said compression members coupled to said upper and said lower limb extend toward said handle portion.

4. The bow of claim 3, wherein said bowstring is slideably secured to said proximal end of said upper limb member and slideably secured to said proximal end of said lower limb member.

5. The bow of claim 4, further comprising one of a notch, a loop, a groove, an eyelet, or a grommet disposed on said proximal end of said upper limb member and said proximal end of said lower limb member.

6. The bow of claim 3, further comprising:

a first pulley disposed on said proximal end of said upper limb member; and a second pulley disposed on said proximal end of said lower limb member;

wherein said bowstring passes through said first pulley and said second pulley prior to coupling said compression members.

7. The bow of claim 2, wherein said compression members coupled to said upper and said lower limb extend away from said handle portion.

8. The bow of claim 7, wherein said bowstring is slideably secured to said proximal end of said upper limb member and slideably secured to said proximal end of said lower limb member.

9. The bow of claim 8, further comprising one of a notch, a loop, a groove, an eyelet, or a grommet disposed on said proximal end of said upper limb member and said proximal end of said lower limb member.

10. The bow of claim 7, further comprising:

a first pulley disposed on said proximal end of said upper limb member; and a second pulley disposed on said proximal end of said lower limb member;

wherein said bowstring passes through said first pulley and said second pulley prior to coupling said compression members.

11. The bow of claim 1, wherein said first and said second compression elements of said first and second compression members are coupled to form a crescent shaped cross section.

12. The bow of claim 1, wherein said first and second compression members comprise a composite material with fiber in a resin matrix.

13. The bow of claim 1, wherein said first and second compression members are configured to store energy as they are compressed by a drawing of said bowstring; and wherein said compression members rapidly return said energy to said bowstring when said bowstring is released, causing said bowstring to thrust toward said handle portion.

14. The bow of claim 1, wherein said compression members are configured to provide let-off when said bowstring is fully drawn.

15. A bow comprising:

a handle portion;

an upper limb member having a proximal end and a distal end, said distal end of said upper limb member being coupled to said handle portion, said proximal end of said upper limb member extending up from said handle portion;

a lower limb member having a proximal end and a distal end, said distal end of said lower limb member being coupled to said handle portion, said proximal end of said lower limb member extending down from said handle portion;

a first compression member coupled to said proximal end of said upper limb;

a second compression member coupled to said proximal end of said lower limb; and a bowstring coupled to said first compression member and said second compression member, wherein said bowstring is configured to compress said first and second compression members when drawn;

wherein said first and second compression members each include:

a primary compression element having a first and second end, wherein said primary compression member is in the form of an arc having a first radius of curvature; and at least one secondary compression element having a first and second end, wherein said secondary compression member is in the form of an arc having a second radius of curvature, said first and second radius of curvature being different;

wherein said first and second ends of said primary compression element are joined to said first and second ends of said secondary compression element;

wherein said first and said second compression elements of said first and second compression members are coupled to form a crescent shaped cross section;

wherein said first and second compression members comprise a composite material with fiber in a resin matrix; and wherein said compression members are configured to provide let-off when said bowstring is fully drawn.

16. The bow of claim 15, wherein said compression members coupled to said upper and said lower limb extend toward said handle portion.

17. The bow of claim 15, wherein said compression members coupled to said upper and said lower limb extend away from said handle portion.

18. The bow of claim 15, further comprising:

a first eccentric disposed on said proximal end of said upper limb member; and a second eccentric disposed on said proximal end of said lower limb member;

wherein said bowstring being configured to actuate said eccentrics; and wherein said eccentrics are mechanically connected to said compression members so as to compress said compression members as said bowstring is pulled away from said handle portion.

19. The bow of claim of 18, wherein said eccentrics provide a mechanical advantage in compressing said compression members as said bowstring is pulled away from said handle portion, and wherein said mechanical advantage provides additional let-off at full draw length.

20. A bow comprising:

a handle portion;

an upper limb member having a proximal end and a distal end, said distal end of said upper limb member being coupled to said handle portion, said proximal end of said upper limb member extending up from said handle portion, said upper limb member being sufficiently rigid to resist any significant deformation as said bow is fired;

a lower limb member having a proximal end and a distal end, said distal end of said lower limb member being coupled to said handle portion, said proximal end of said lower limb member extending down from said handle portion, said lower limb member being sufficiently rigid to resist any significant deformation as said bow is fired;

a first compression member coupled to said proximal end of said upper limb;

a second compression member coupled to said proximal end of said lower limb; and a bowstring coupled to said first compression member and said second compression member, wherein said bowstring is configured to compress said first and second compression members when drawn;

wherein said first and second compression members each include a primary arcuate compression element and at least one secondary arcuate compression element.

* * * * *